US007403158B2

(12) United States Patent
Kikin

(10) Patent No.: US 7,403,158 B2
(45) Date of Patent: Jul. 22, 2008

(54) COMPACT CIRCULAR POLARIZED ANTENNA

(75) Inventor: Vadim Kikin, Spring Valley, NY (US)

(73) Assignee: Applied Wireless Identification Group, Inc., Morgan Hill, CA (US)

( * ) Notice: Subject to any disclaimer, the term of this patent is extended or adjusted under 35 U.S.C. 154(b) by 60 days.

(21) Appl. No.: 11/253,099

(22) Filed: Oct. 18, 2005

(65) Prior Publication Data

US 2007/0085742 A1 Apr. 19, 2007

(51) Int. Cl.
*H01Q 1/38* (2006.01)

(52) U.S. Cl. ..... 343/700 MS; 343/846; 340/572.7

(58) Field of Classification Search ..... 343/700 MS, 343/846, 841; 340/505, 572.1, 572.7
See application file for complete search history.

(56) References Cited

U.S. PATENT DOCUMENTS

| | | | | |
|---|---|---|---|---|
| 3,216,016 | A | 11/1965 | Tanner | 343/719 |
| 4,191,959 | A | 3/1980 | Kerr | 343/700 |
| 4,987,421 | A | 1/1991 | Sunahara et al. | 343/700 |
| 5,055,852 | A | 10/1991 | Dusseux et al. | 343/725 |
| 5,075,691 | A | 12/1991 | Garay et al. | 343/830 |
| 5,371,507 | A | 12/1994 | Kuroda et al. | 343/700 |
| 5,675,346 | A | 10/1997 | Nishikawa et al. | 343/700 |
| 6,023,244 | A | 2/2000 | Snygg et al. | 343/700 |
| 6,124,829 | A * | 9/2000 | Iwasaki | 343/700 MS |
| 6,163,306 | A | 12/2000 | Nakamura et al. | 343/797 |
| 6,300,908 | B1 | 10/2001 | Jecko et al. | 343/700 |
| 6,307,511 | B1 | 10/2001 | Ying et al. | 343/702 |
| 6,329,950 | B1 | 12/2001 | Harrell et al. | 343/700 |
| 6,407,707 | B2 | 6/2002 | Nakamura et al. | 343/700 |
| 6,567,056 | B1 | 5/2003 | Waltho | 434/797 |
| 6,876,328 | B2 * | 4/2005 | Adachi et al. | 343/700 MS |
| 6,956,529 | B1 * | 10/2005 | Chen | 343/700 MS |
| 6,992,630 | B2 * | 1/2006 | Parsche | 343/700 MS |
| 7,019,704 | B2 * | 3/2006 | Weiss | 343/770 |
| 2004/0246181 | A1 | 12/2004 | Fukushima et al. | 343/700 |
| 2005/0088342 | A1 | 4/2005 | Parsche | 343/700 |
| 2005/0110689 | A1 * | 5/2005 | Masutani | 343/700 MS |

FOREIGN PATENT DOCUMENTS

| | | |
|---|---|---|
| JP | 2003152431 | 5/2003 |

OTHER PUBLICATIONS

Search Report and Written Opinion from PCT Application No. PCT/US06/40958 mailed on Nov. 14, 2007.

* cited by examiner

*Primary Examiner*—Tan Ho
(74) *Attorney, Agent, or Firm*—Zilka-Kotab, PC

(57) ABSTRACT

A circular polarized antenna having an electrically conductive element having a generally annular outer portion and first and second inner members coupled to the outer portion. A ground shield is spaced from the element, the ground shield providing an effective ground plane. A dielectric material is positioned between the element and at least a portion of the ground shield.

30 Claims, 7 Drawing Sheets

COMPACT CIRCULAR POLARIZED ANTENNA

FIELD OF THE INVENTION

The present invention relates to Radio Frequency (RF) antennas, and more particularly, this invention relates to an antenna featuring an annular shape with thin metal conductor traversing the central opening thereof.

BACKGROUND OF THE INVENTION

Newer designs and manufacturing techniques have driven electronic components to small dimensions and miniaturized many communication devices and systems. Unfortunately, antennas have not been reduced in size at a comparative level and often are one of the larger components used in a smaller communications device. For instance, directional RF antennas use plates as the radiating conductor. However, to achieve good performance, such devices tend to be very large, as the antenna diameter depends on the operating wavelength. The wavelengths of 46-49 MHz signals are 18 feet, while 900 MHz signals are about one foot long. Modern technologies such as Radio Frequency Identification (RFID) would benefit from smaller antenna size.

In current, everyday communications devices, many different types of patch antennas, loaded whips, copper springs (coils and pancakes) and dipoles are used in a variety of different ways. These antennas, however, are sometimes large and impractical for a specific application. For instance, a 900 MHz directional antenna requires a 1 foot diameter footprint. Current attempts to produce smaller directional antennas are often referred to as patch antennas. Conventional patch antennas typically have a ground plane diameter about equal to, or larger than, the operating wavelength, e.g., typically have a diameter of about 6-8 inches at 900 MHz. Such antennas provide a gain on the order of +8 dBic or +6 dBi, where dBic refers to antenna gain, decibels referenced to a circularly polarized, theoretical isotropic radiator and dBi refers to antenna gain, decibels referenced to a theoretical isotropic radiator.

However, to achieve the reduced size, patch antennas have heretofore been constructed with high dielectric constant materials, e.g., ceramics, metal oxides, etc., making them both expensive, and very heavy. The additional weight makes such antennas impractical for implementation in portable devices, cost more to ship, etc. A further drawback of antennas implementing the high dielectric constant materials is that they only operate in a narrow bandwidth.

Thus, it would be desirable to not only reduce antenna size and weight, but also to do so without significant degradation of gain and bandwidth.

SUMMARY OF THE INVENTION

To provide the aforementioned desirable advantages, a compact, low weight, high gain, circular polarized antenna is disclosed that provides high gain for a minimal amount of area.

A circular polarized antenna according to one embodiment includes an electrically conductive element having a generally annular outer portion and first and second elongate inner members coupled to the outer portion. A ground shield is spaced from the element, the ground shield providing an effective ground plane, the effective ground plane having a maximum width in a direction parallel to a plane of the element of less than about one half and in some embodiments less than about one-third, of an operating wavelength. A dielectric material is positioned between the element and at least a portion of the ground shield.

A circular polarized antenna according to another embodiment includes a substantially square-shaped electrically conductive element having a plurality of voids defined therein, edges of the element along the voids defining an outer portion of the element and at least two elongate inner members of the element. A ground shield is spaced from the element and having a substantially square-shaped outer periphery, the ground shield providing an effective ground plane, the effective ground plane having widths in a direction parallel to a plane of the element and perpendicular to each other and perpendicular to straight sections of the outer periphery of less than about one-third of an operating wavelength. A dielectric material is positioned between the element and at least a portion of the ground shield.

A circular polarized antenna according to yet another embodiment includes an electrically conductive element having a generally annular outer portion and inner members extending from an inner periphery of the outer portion and lying in about the same plane as the outer portion. A ground shield is spaced from the element. A dielectric material is positioned between the element and at least a portion of the ground shield, the dielectric material having a dielectric constant less than about 2 at 0° C., ideally less than about 1.1 at 0° C.

System implementations are also presented, including RFID systems. RFID systems typically include a plurality of RFID tags and an RFID interrogator in communication with the RFID tags.

Other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

BEST MODE FOR CARRYING OUT THE INVENTION

Figure 1:
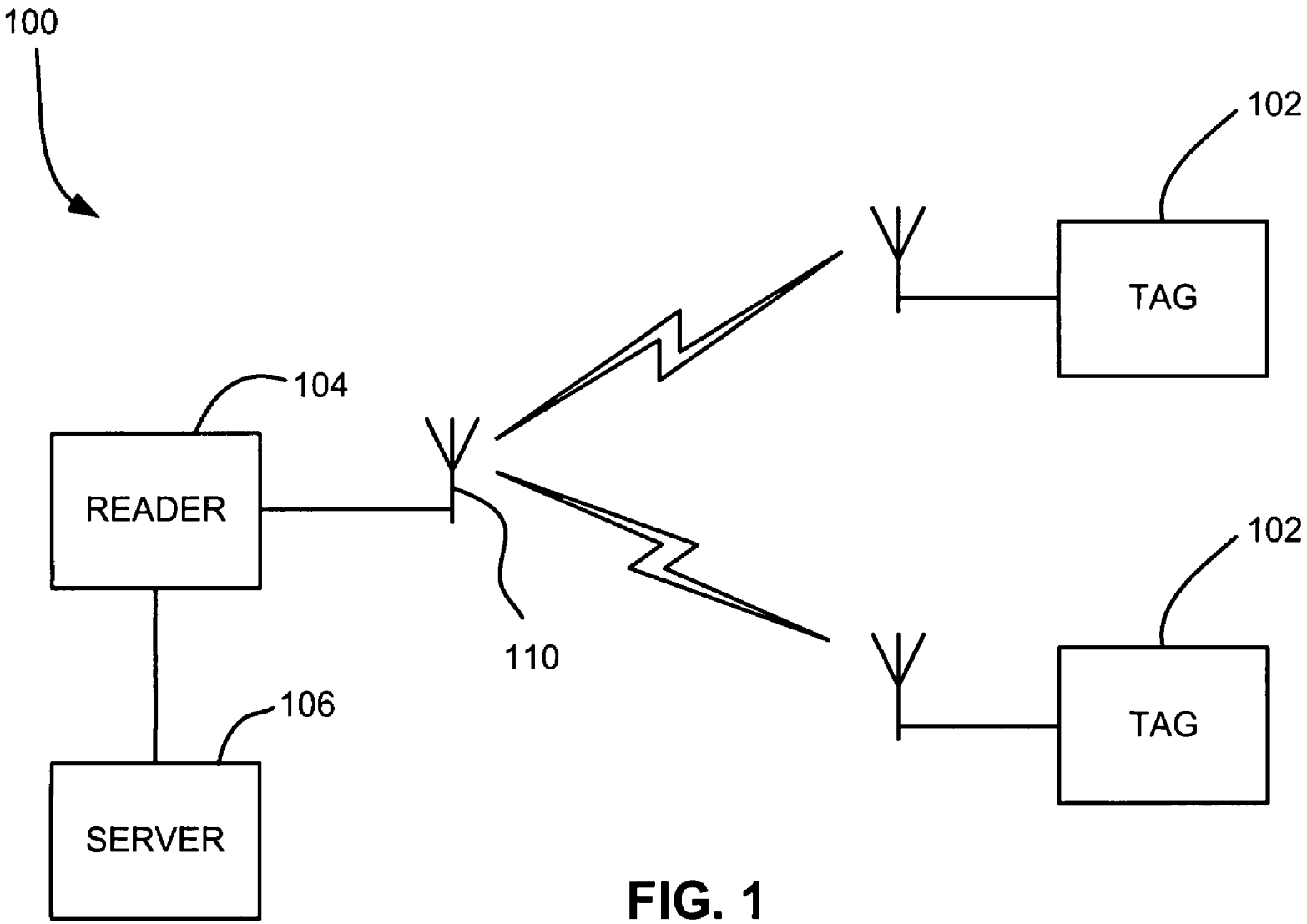
FIG. 1 is a system diagram of an RFID system.

The following description is the best mode presently contemplated for carrying out the present invention. This description is made for the purpose of illustrating the general principles of the present invention and is not meant to limit the inventive concepts claimed herein. Further, particular features described herein can be used in combination with other described features in each and any of the various possible combinations and permutations.

In the drawings, like and equivalent elements are numbered the same throughout the various figures.

The following specification describes a compact circular polarized antenna that provides high gain for a minimal amount of area and weight. The antenna is annular in geometry to maximize surface area for the minimum dimensions. Antennas constructed as described herein exhibit a gain of greater than about 2 dBi, and in most instances, greater than about 6 dBic or 3 dBic within a similar frequency band as conventional patch antennas. The reduction in size is achieved by implementing a unique radiating element design, low dielectric constant material, and a ground shield.

Many types of devices can take advantage of the embodiments disclosed herein, including but not limited to Radio Frequency Identification (RFID) systems (all Classes) and other wireless devices/systems; portable electronic devices such as portable telephones and other audio/video communications devices; and virtually any type of electronic device where an antenna is utilized. To provide a context, and to aid in understanding the embodiments of the invention, much of the present description shall be presented in terms of an RFID system such as that shown in FIG. 1. It should be kept in mind that this is done by way of example only, and the invention is not to be limited to RFID systems, as one skilled in the art will appreciate how to implement the teachings herein into electronics devices in hardware and, where appropriate, software. Examples of hardware include Application Specific Integrated Circuits (ASICs), printed circuits, monolithic circuits, reconfigurable hardware such as Field Programmable Gate Arrays (FPGAs), etc.

As shown in FIG. 1, an RFID system 100 includes RFID tags 102, a reader 104, and an optional backend system, e.g., server 106. Each tag 102 includes an IC chip and an antenna. The IC chip includes a digital decoder needed to execute the computer commands that the tag 102 receives from the tag reader 104. In some tags 102, the IC chip also includes a power supply circuit to extract and regulate power from the RF reader; a detector to decode signals from the reader; a backscatter modulator, a transmitter to send data back to the reader; anti-collision protocol circuits; and at least enough memory to store its EPC code.

Communication begins with a reader 104 sending out signals via an antenna 110 to find the tag 102. When the radio wave hits the tag 102 and the tag 102 recognizes and responds to the reader's signal, the reader 104 decodes the data programmed into the tag 102 and sent back in the tag+ reply. The information can then be passed to the optional server 106 for processing, storage, and/or propagation to another computing device. By tagging a variety of items, information about the nature and location of goods can be known instantly and automatically.

RFID systems may use reflected or "backscattered" radio frequency (RF) waves to transmit information from the tag 102 to the reader 104. Since passive (Class-1 and Class-2) tags get all of their power from the reader signal, the tags are only powered when in the beam of the reader 104. Class-3 and higher tags may include an on-board power source, e.g., a battery.

Figure 2:
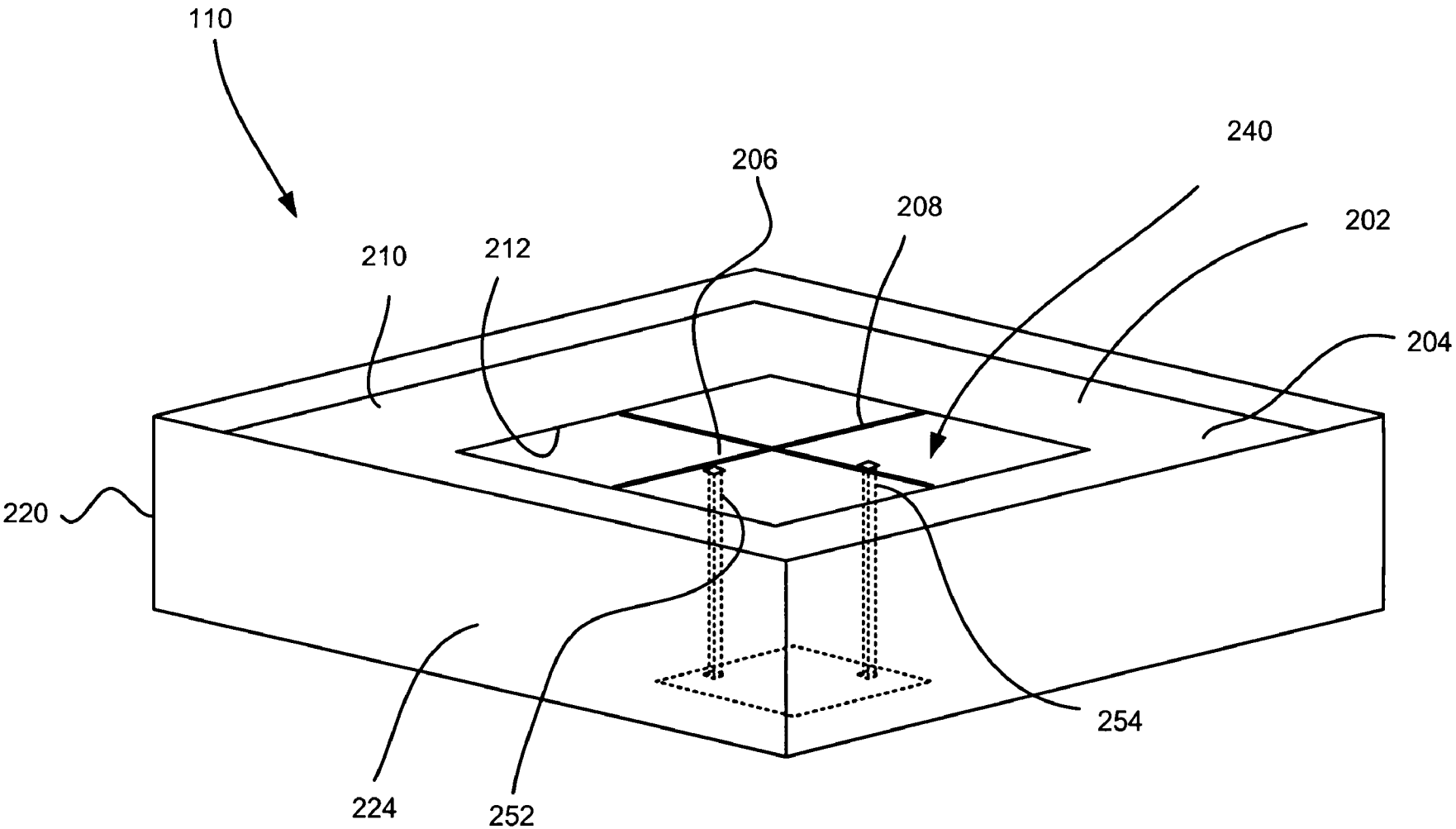
FIG. 2 is a perspective view of an antenna according to one embodiment.
Figure 3:
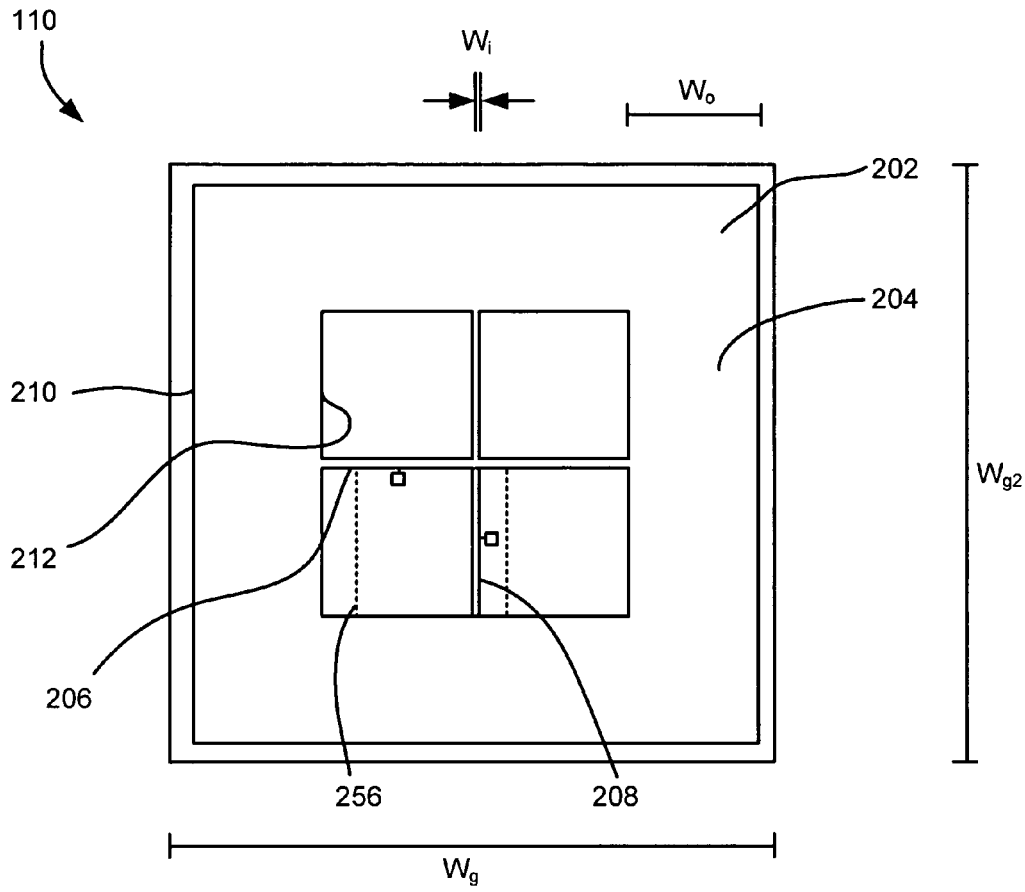
FIG. 3 is a side view of the antenna of FIG. 2.
Figure 4:
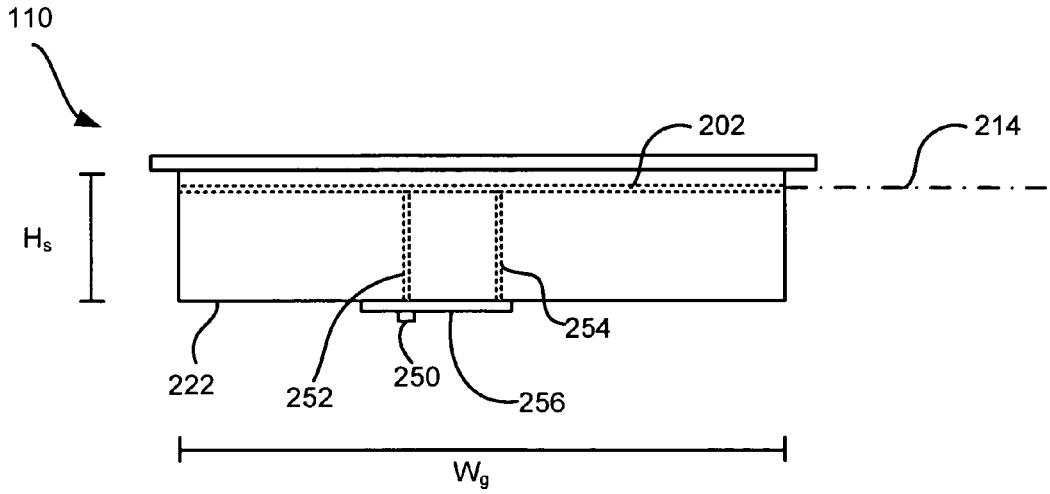
FIG. 4 is a side view of the antenna of FIG. 2.
Figure 5A:
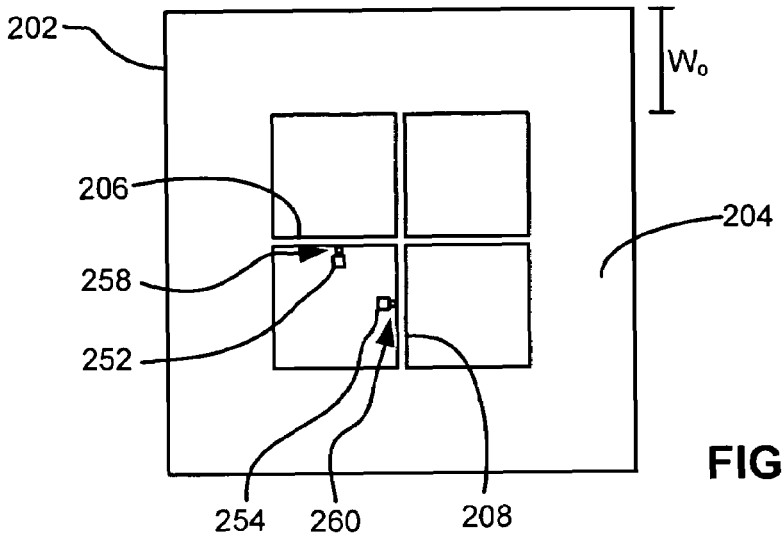
FIG. 5A is a side view of a radiating element according to an embodiment.
Figure 5B:
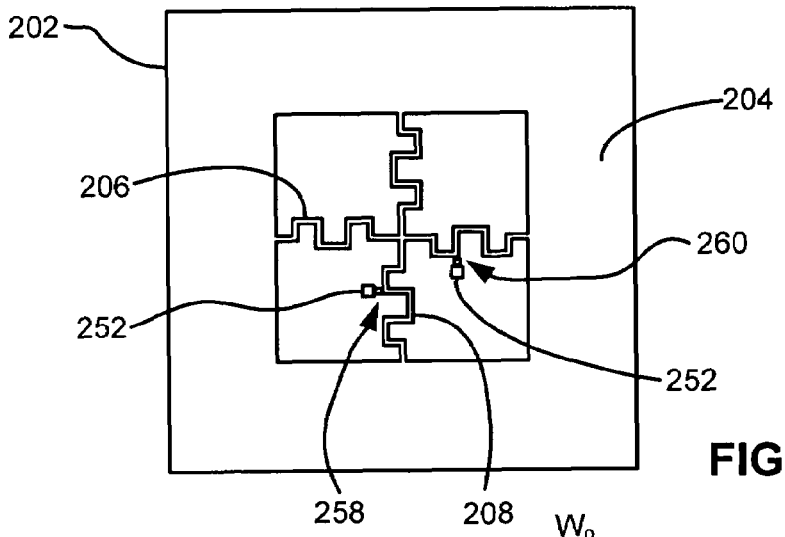
FIG. 5B is a side view of a radiating element according to an embodiment.

FIGS. 2-4 illustrate an antenna 110 according to one embodiment of the present invention. As shown, a conductive radiating element 202 positioned above a ground shield 220. A dielectric material 240 is positioned between the element and the ground shield, and may serve as the support for the element 202.

The element 202 has a generally annular outer portion 204 and first and second elongate inner members 206, 208 coupled to the outer portion 204. The outer portion 204 is a preferably continuous layer of conductive material. The outer portion 204 preferably has a generally rectangular inner periphery 210 and outer periphery 212 that approximates the shape of the ground shield 220. In the embodiment shown, the outer portion 204 has square shaped peripheries 210, 212.

The inner members 206, 208 preferably lie along a common plane 214 with the outer portion 204. In some embodiments, the inner members 206, 208 are continuous with the outer portion 204 and/or each other, i.e., formed in the same processing step such that there are no seams between the outer portion 204 and the inner members 206, 208. For instance, the outer portion 204 and inner members 206, 208 can be formed simultaneously by deposition on a substrate such as a printed circuit board. Alternatively, the element 202 can be formed as a large continuous sheet, and voids created therein, e.g., by cutting or stamping, to define the inner members 206, 208. In other embodiments, the inner members 206, 208 are coupled to the outer portion 204 and/or each other, e.g., by welding, soldering, riveting, etc. The cross-sectional shape of the inner members 206, 208 is not critical, and can be rectangular, round, oval-shaped, etc. The length to width ratio of the inner members 206, 208 may be in a range of 2:1 to 1000:1. An illustrative embodiment has inner members 206, 208 with an axial length to cross sectional width ratio of 10:1.

The inner members 206, 208 may be long and thin relative to the width $W_o$ of the outer portion 204. The width $W_o$ of the outer portion 204 is preferably at least 2× the width $W_i$ of the inner members 206, 208. In other embodiments, the width $W_o$ of the outer portion 204 is in the range of between 2× and 100× the width $W_i$ of each inner member, e.g., 4×, 5×, 6×, 7×, 8×, 10×, 20×, 100×, etc.

The width $W_g$ of the ground plane is preferably at least 2.5× the width $W_o$ of the outer portion 204. In other embodiments, the width $W_g$ of the ground plane is in the range of between 2.5× and 10× the width $W_o$ of the outer portion 204, e.g., 3×, 4×, 5×, etc.

In a preferred embodiment, the size of the conductive area of the element 202 is sufficient to maintain a high surface current and associated magnetic field, and the gap between the element 202 and the ground shield 220 is sufficient to produce an electric field in any phase of the stimulus source at the port 250 of the antenna 110.

Figure 6:
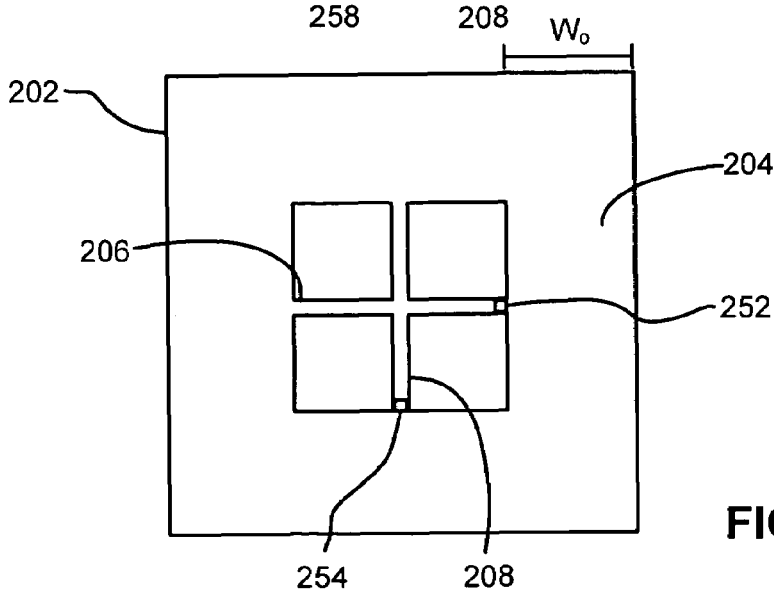
FIG. 6 is a side view of a radiating element according to an embodiment.

As shown in FIGS. 2-3, the elongate inner members 206, 208 may cross each other such that each of the elongate inner members 206, 208 have two points of contact with the outer portion 204. Additional configurations of the element 202 are shown in FIGS. 5A-10. In the embodiment shown in FIG. 5A, the inner members 206, 208 are straight, and coupling lumped capacitors 258, 260 are positioned at the radiating element and coupled to feeding pins 252, 254 that carry the signal to the radiating element 202. In the embodiment shown in FIG. 5B, the inner members 206, 208 are folded, and coupling lumped capacitors 258, 260 are positioned at the radiating element. In the embodiment shown in FIG. 6, the inner members 206, 208 are straight and wider, while the outer portion 204 of the element 202 has a greater width $W_o$ than other embodiments such as the element shown in FIG. 5A. The coupling lumped capacitors 258, 260 of the embodiment of FIG. 6 are preferably positioned at the phase shift element 256 (FIG. 4).

Figure 7:
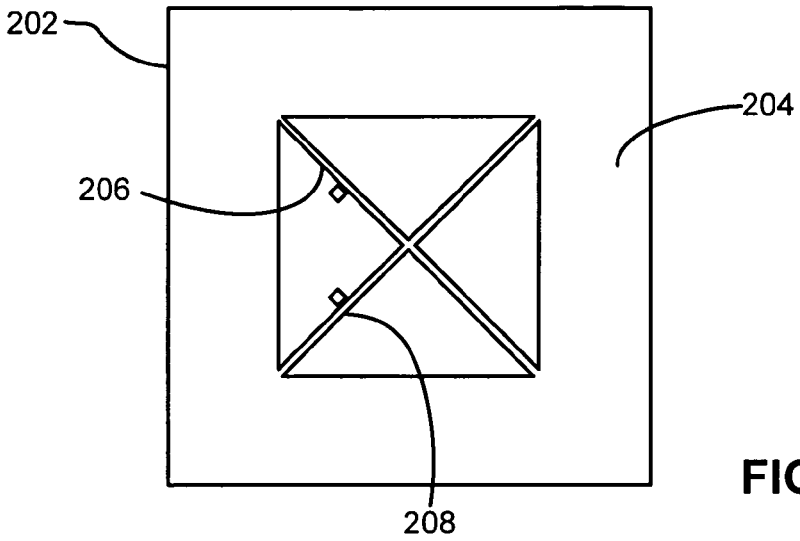
FIG. 7 is a side view of a radiating element according to an embodiment.
Figure 8:
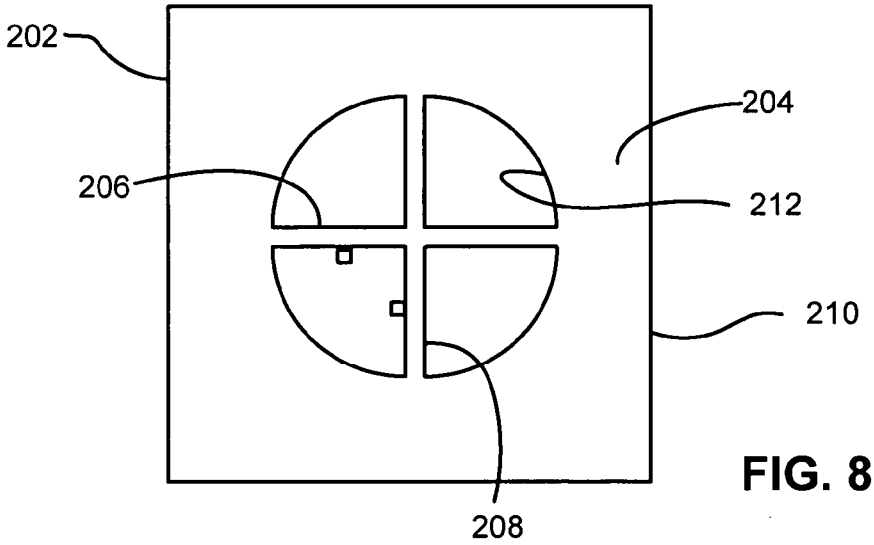
FIG. 8 is a side view of a radiating element according to an embodiment.
Figure 9:
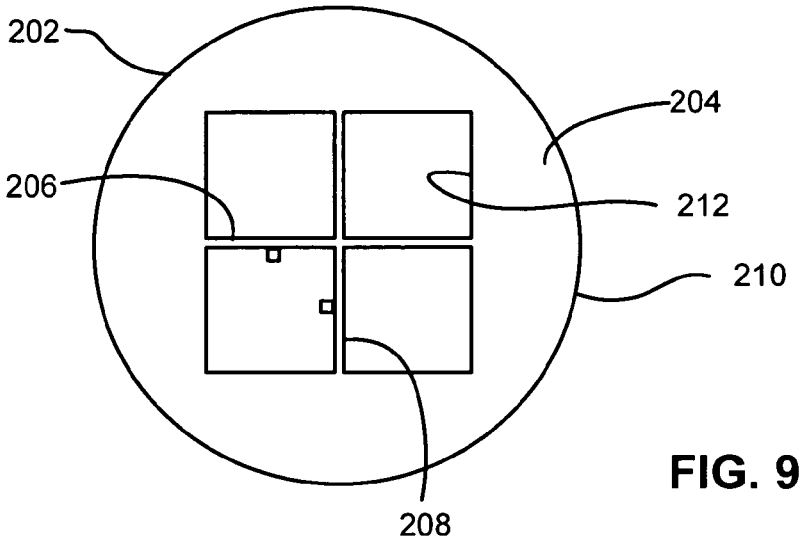
FIG. 9 is a side view of a radiating element according to an embodiment.
Figure 10:
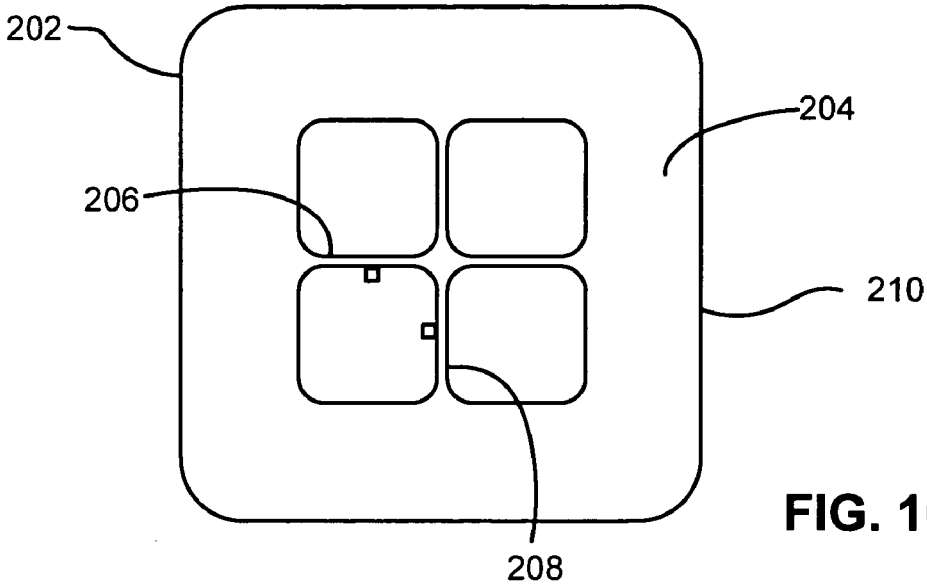
FIG. 10 is a side view of a radiating element according to an embodiment.

In the embodiment shown in FIG. 7, the inner members 206, 208 extend from corners rather than the straight sections of the inner periphery of the outer portion 204. As shown in FIG. 8, the inner periphery of the outer portion 204 may be rounded while the outer periphery is rectangular. As shown in FIG. 9, the inner periphery of the outer portion 204 may be rectangular while the outer periphery is rounded. FIG. 10 depicts yet another element 202, which has rounded corners. Further variations and combinations of these embodiments are possible. For example, another contemplated embodiment has an outer portion with a rounded inner periphery as in FIG. 8 and a rounded outer periphery as in FIG. 9. Yet another contemplated embodiment has an outer portion with a polygonal (e.g., triangular, rectangular, pentagonal, hexagonal, octoganol, etc.) inner and/or outer periphery.

Any electrically conductive material can be used to form the element 202, with metals being preferred. Illustrative materials from which to form the element 202 include copper, aluminum, etc. The elements described above, and especially those shown in FIGS. 2-4, permit a reduced resonance frequency of the resonator formed inside the ground shield 220.

With continued reference to FIGS. 2-4, the element 202 is positioned above a ground shield 220 that provides an effective ground plane. While the ground shield 220 may be a planar sheet, the ground shield 220 shown is a box having a generally rectangular bottom 222 with a peripheral sidewall 224 that extends upwardly from the bottom 222. The peripheral sidewall 224 preferably extends to a point beyond the plane 214 of the element 202. Thus, a portion of the ground shield 220 lies on the same plane 214 as the element 202. This has surprisingly been found to improve both the gain and directionality of the overall antenna 110.

Preferably, the ground shield 220 is positioned closest to the element 202 in an area where the ground shield 220 is in the same plane 214 as the element 202. In other words, a distance between the element 202 and the portion of the ground shield 220 lying along the same plane 214 as the element 202 is less than a distance between the ground shield 220 and the element 202 as measured in a direction perpendicular to the plane 214 of the element 202.

The effective ground plane created by the ground shield 220 preferably has a width $W_g$ in a direction parallel to a plane 214 of the element 202 of less than about ½ of an operating wavelength of the antenna 110. Thus, for example, for an antenna transmitting a 900 MHz signal, the operating wavelength would be about 1 foot, and the width $W_g$ of the effective ground plane would be about 6 inches or less. Preferably, the width $W_g$ of the effective ground plane is less than about one-third of the operating wavelength. Thus, for example, for an antenna transmitting a 900 MHz signal, the operating wavelength would be about 1 foot, and the width $W_g$ of the effective ground plane would be about 4 inches or less. The width $W_g$ of the effective ground plane in one embodiment is greater than about one-ninth of the operating wavelength, but can be smaller.

Note that the width $W_g$ of the effective ground plane as shown is a width between the straight sections of the ground shield 220 sidewall. The width of the effective ground plane can also be measured from corner to corner of the ground shield 220, which will then be the maximum width of the ground shield 220. The same constraints as defined above can be applied to the maximum width. Further, a second width $W_{g2}$ can be defined perpendicular to the first width $W_g$, and $W_{g2}$ may or may not equal $W_g$.

In an illustrative embodiment, the widths $W_g$, $W_{g2}$ of the ground shield 220 are each between about 1 and about 5 inches. An illustrative height $H_s$ of the peripheral sidewall 224 of the ground shield 220 (if present) is between about 0.25 inches and about 2 inches. One experimental embodiment has a ground shield 220 with $W_g$=4 inches, $W_{g2}$=4 inches, and $H_s$=0.88 inches. The distance between the plane 214 of the element 202 and the bottom 222 of the ground shield 220 is in the range of between about 0.25 inches and about 0.85 inches.

Any electrically conductive material can be used to form the ground shield 220, with metals being preferred. Illustrative materials from which to form the element 202 include copper, aluminum, etc.

A dielectric material 240 is positioned between the element 202 and at least a portion of the ground shield 220. A dielectric material is a substance that is a poor conductor of electricity, but an efficient supporter of electrostatic fields. To reduce the overall weight of the antenna 110, the dielectric material 240 preferably has a low dielectric constant, e.g., a dielectric constant of less than about 2 at 0° C., ideally less than about 1.1 at 0° C. Substances with a low dielectric constant include a vacuum, air, and most gases such as helium and nitrogen. Accordingly, one preferred dielectric material is a gas such as air. Air has a dielectric constant of 1 at 0° C. and 1 atmosphere. Accordingly, the element 202 may be supported above the bottom of the ground shield 220, e.g., by a printed circuit board or other substantially RF transparent substrate, thereby sandwiching a layer of air therebetween. If a definable layer of dielectric material is desired, a material having air in voids thereof, such as STYROFOAM, sponges, etc. may also be used. A container or bladder encapsulating the dielectric material 240 can also or alternatively be provided between the element 202 and the ground shield 220. The latter embodiments may provide the additional benefit of giving additional support to the element 202.

With continued reference to FIGS. 2-4, signals from a signal generating device, e.g., frequency and/or amplitude modulator, etc. (not shown) are introduced to the antenna 110 at a port 250. Conductive feeding pins 252, 254 carry the signal from the port 250 to the inner members 206, 208 of the element 202. The signals sent through the feeding pins 252, 254 have different phases relative to each other, as induced by a conventional phase shift element 256. In the embodiment shown in FIGS. 2-4, the phase shift element 256 is a conventional 90 degree phase shift element. One illustrative 90 degree phase shift element is a Broad Band 3 dB 90 degree Hybrid Power Splitter. The 90 degree phase shift element can also be implemented with a delay line to one of the feeding pins.

Coupling capacitors 258, 260 are preferably formed between the feeding pins 252, 254 and the inner members 206, 208. Note that a distributor plate can be used instead of the coupling capacitors 258, 260.

Figure 11:
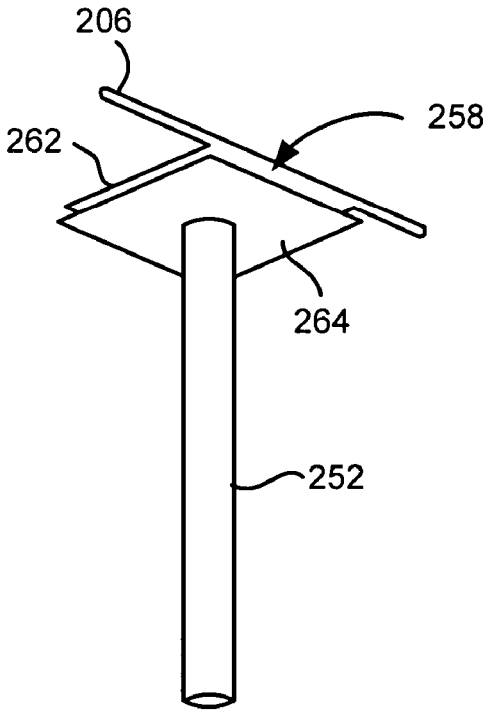
FIG. 11 is a partial perspective view of a feeding pin capacitively coupled with a radiating element according to an embodiment.
Figure 12:
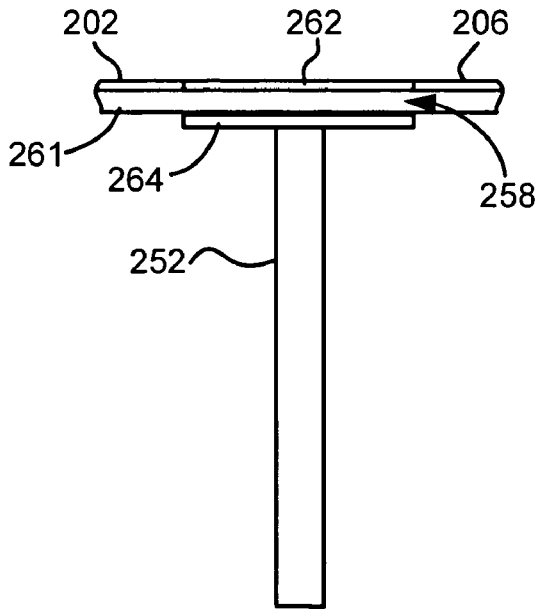
FIG. 12 is a partial side view of a feeding pin capacitively coupled with a radiating element according to an embodiment.

FIGS. 11 and 12 illustrate an embodiment where a coupling capacitors 258 is formed between metal pads 262, 264 positioned on opposite sides of the thin dielectric substrate 261 that supports the radiating element 202. As shown, inner member 206 has a pad 262 extending therefrom that faces a pad 264 on the feeding pin 252. A capacitance is created between the pads 262, 264 across the thin dielectric supporting substrate 261.

Figure 13:
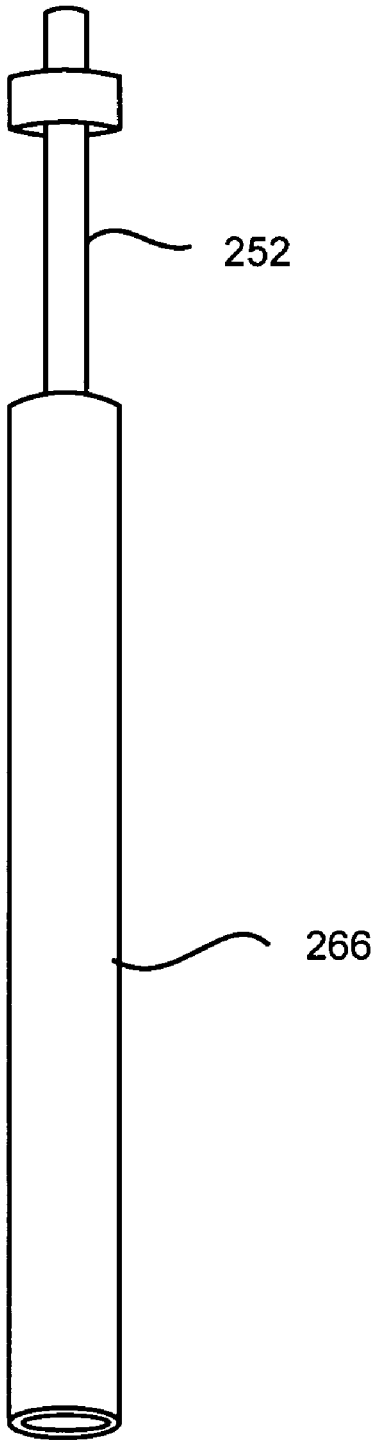
FIG. 13 is a partial perspective view of a feeding pin capacitively coupled with a sleeve according to an embodiment.
Figure 14:
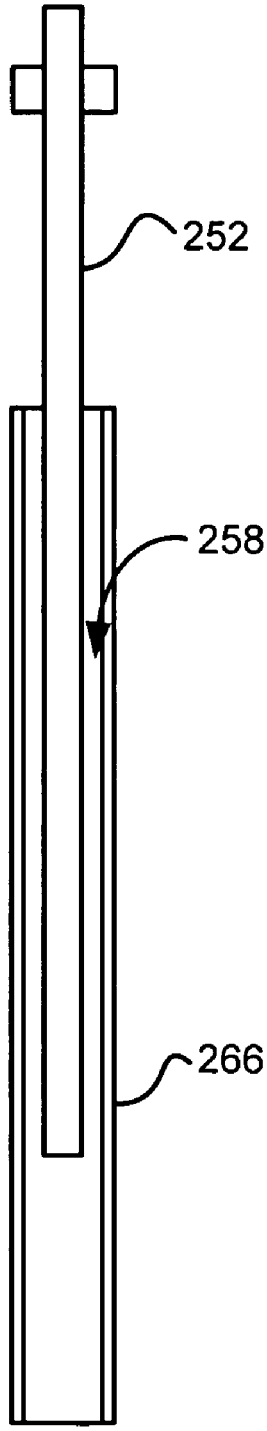
FIG. 14 is a partial cross sectional view of a feeding pin capacitively coupled with a sleeve according to an embodiment.

FIGS. 13 and 14 illustrate an embodiment where a coupling capacitor 258 is formed between the feeding pin 252, connected to the radiating element and the additional sleeve 266, connected to the phase shift element. Here, a capacitance is formed between the feeding pin 252 and sleeve 266.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A circular polarized antenna, comprising:

an electrically conductive element having:

a generally annular outer portion, the outer portion having an outer periphery and an inner periphery; and first and second elongate inner members coupled to the outer portion;

a ground shield spaced from the element, the ground shield providing an effective ground plane, the effective ground plane having a maximum width in a direction parallel to a plane of the element of less than about one-half of an operating wavelength; and a dielectric material positioned between the element and at least a portion of the ground shield.

2. An antenna as recited in claim 1, wherein the first and second elongate inner members lie along a common plane with the outer portion.

3. An antenna as recited in claim 1, wherein the first and second elongate inner members cross each other, each of the elongate inner members having two points of contact with the outer portion.

4. An antenna as recited in claim 1, wherein the outer periphery of the outer portion is generally rectangular shaped.

5. An antenna as recited in claim 1, wherein the inner and outer peripheries of the outer portion are square shaped.

6. An antenna as recited in claim 5, wherein the inner periphery of the outer portion includes corners and straight edges, wherein the first and second elongate inner members are perpendicular to each other and extend between straight edges of the inner periphery of the outer portion.

7. An antenna as recited in claim 6, wherein the first and second elongate inner members lie along a common plane with the outer portion, wherein the first and second elongate inner members are continuous with the outer portion.

8. An antenna as recited in claim 1, wherein the first and second elongate inner members are folded.

9. An antenna as recited in claim 1, wherein a length to width ratio of each elongate inner member is at least about 10 to 1.

10. An antenna as recited in claim 1, further comprising a first feeding pin coupled to the first elongate inner member and a second feeding pin coupled to the second elongate inner member, wherein signals sent to the feeding pins have different phases relative to each other.

11. An antenna as recited in claim 1, wherein a portion of the ground shield lies on a same plane as the element.

12. An antenna as recited in claim 11, wherein the ground shield is positioned closest to the element in an area where the ground shield is in the same plane as the element.

13. An antenna as recited in claim 1, wherein the dielectric material has a dielectric constant less than about 2 at 0° C.

14. An antenna as recited in claim 1, wherein a gain of the antenna is greater than about 2 dBi.

15. An antenna as recited in claim 1, wherein a width of the outer portion as measured between the inner and outer peripheries thereof is at least twice a width of each of the elongate inner members as measured in a direction perpendicular to an axis thereof and parallel to a plane of the element.

16. A Radio Frequency Identification (RFID) system, comprising:

a plurality of RFID tags; and an RFID interrogator in communication with the RFID tags, the RFID interrogator being coupled to the antenna of claim 1.

17. A circular polarized antenna, comprising:

a substantially square-shaped electrically conductive element having a plurality of voids defined therein, edges of the element along the voids defining an outer portion of the element and at least two elongate inner members of the element;

a ground shield spaced from the element and having a substantially square-shaped outer periphery, the ground shield providing an effective ground plane, the effective ground plane having widths in a direction parallel to a plane of the element and perpendicular to each other and perpendicular to straight sections of the outer periphery of less than about one-third of an operating wavelength; and a dielectric material positioned between the element and at least a portion of the ground shield.

18. An antenna as recited in claim 17, wherein the elongate inner members lie along a common plane with the outer portion.

19. An antenna as recited in claim 17, wherein the elongate inner members cross each other perpendicularly, each of the elongate inner members having two points of contact with the outer portion.

20. An antenna as recited in claim 17, wherein the elongate inner members are folded.

21. An antenna as recited in claim 17, wherein the inner periphery of the outer portion includes corners and straight edges, wherein the elongate inner members are perpendicular to each other and extend between straight edges of the inner periphery of the outer portion.

22. An antenna as recited in claim 17, further comprising a first feeding pin coupled to one of the elongate inner members and a second feeding pin coupled to another of the elongate inner members, wherein signals sent to the feeding pins have different phases relative to each other.

23. A Radio Frequency Identification (RFID) system, comprising:

a plurality of RFID tags; and an REID interrogator in communication with the REID tags, the RFID interrogator being coupled to the antenna of claim 17.

24. A circular polarized antenna, comprising:

a substantially square-shaped electrically conductive element having a plurality of voids defined therein, edges of the element along the voids defining an outer portion of the element and at least two elongate inner members of the element;

a ground shield spaced from the element and having a substantially square-shaped outer periphery, the ground shield providing an effective ground plane, the effective ground plane having widths in a direction parallel to a plane of the element and perpendicular to each other and perpendicular to straight sections of the outer periphery of less than about one-third of an operating wavelength, wherein a portion of the ground shield lies on a same plane as the element; and a dielectric material positioned between the element and at least a portion of the ground shield.

25. An antenna as recited in claim 24, wherein the ground shield is positioned closest to the element in an area where the ground shield is in the same plane as the element.

26. A circular polarized antenna, comprising:

an electrically conductive element having a generally annular outer portion and inner members extending from an inner periphery of the outer portion and lying in about the same plane as the outer portion;

a ground shield spaced from the element, the ground shield providing an effective ground plane, the effective ground plane having a maximum width in a direction parallel to a plane of the element of less than about one-half of an operating wavelength; and a dielectric material positioned between the element and at least a portion of the ground shield, the dielectric material having a dielectric constant less than about 2 at 0° C.

27. An antenna as recited in claim 26, wherein a portion of the ground shield lies on the same plane as the element.

28. An antenna as recited in claim 26, further comprising a first feeding pin coupled to a first of the inner members and a second feeding pin coupled to a second of the inner members, wherein signals sent to the feeding pins have different phases relative to each other.

29. An antenna as recited in claim 26, wherein a length to width ratio of each inner member is at least about 10 to 1.

30. A Radio Frequency Identification (RFID) system, comprising:

a plurality of RFID tags; and an RFID interrogator in communication with the RFID tags, the RFID interrogator being coupled to the antenna of claim 26.

* * * * *

UNITED STATES PATENT AND TRADEMARK OFFICE

CERTIFICATE OF CORRECTION

PATENT NO. : 7,403,158 B2
APPLICATION NO. : 11/253099
DATED : July 22, 2008
INVENTOR(S) : Vadim Kikin It is certified that error appears in the above-identified patent and that said Letters Patent is hereby corrected as shown below:

In the specification:
col. 3, line 65 change “tag+” to --tag’--.

In the claims:
col. 8, line 53 change “an REID interrogator in communication with the REID” to --an RFID interrogator in communication with the RFID--.

Signed and Sealed this

Second Day of December, 2008

JON W. DUDAS
*Director of the United States Patent and Trademark Office*